US006497108B2

(12) United States Patent
Collins et al.

(10) Patent No.: US 6,497,108 B2
(45) Date of Patent: Dec. 24, 2002

(54) DEFROST CONTROL METHOD FOR REDUCING FREEZER PACKAGE TEMPERATURE DEVIATION

(75) Inventors: Martin Collins, Greenville, MI (US); Harold Mawby, Belding, MI (US)

(73) Assignee: White Consolidated Industries, Inc., Cleveland, OH (US)

( * ) Notice: Subject to any disclaimer, the term of this patent is extended or adjusted under 35 U.S.C. 154(b) by 0 days.

(21) Appl. No.: 09/966,273

(22) Filed: Sep. 28, 2001

(65) Prior Publication Data

US 2002/0139130 A1 Oct. 3, 2002

Related U.S. Application Data

(60) Provisional application No. 60/280,290, filed on Mar. 30, 2001.

(51) Int. Cl.[7] ..... F25D 21/06; F25D 21/00

(52) U.S. Cl. ..... 62/155; 62/234

(58) Field of Search ..... 62/155, 234, 151, 62/157, 80, 140

(56) References Cited

U.S. PATENT DOCUMENTS

| | | | | | |
|---|---|---|---|---|---|
| 4,590,771 | A | * | 5/1986 | Shaffer et al. | 62/156 |
| 4,843,833 | A | * | 7/1989 | Polkinghorne | 62/180 |
| 4,879,878 | A | * | 11/1989 | Polkinghorne | 62/187 |
| 4,959,968 | A | * | 10/1990 | Fukuda | 62/155 |
| 4,967,568 | A | * | 11/1990 | Harnden, Jr. et al. | 62/155 |
| 4,989,413 | A | * | 2/1991 | Fukuda | 62/155 |
| 5,842,355 | A | * | 12/1998 | Kalis et al. | 62/234 |

* cited by examiner

*Primary Examiner*—Denise L. Esquivel
*Assistant Examiner*—Marc Norman
(74) *Attorney, Agent, or Firm*—Pearne & Gordon LLP

(57) ABSTRACT

Method for controlling a defrost cycle in a freezer so the defrost cycle begins at the end of a compressor operation. For the defrost cycle to begin, the compressor must have been operating for a minimum duration or the compressor must operate for a period which is a certain minimum percentage of a previous compressor operating time.

10 Claims, 3 Drawing Sheets

DEFROST CONTROL METHOD FOR REDUCING FREEZER PACKAGE TEMPERATURE DEVIATION

CROSS-REFERENCE TO RELATED APPLICATIONS

This application claims the benefit of U.S. Provisional Application Serial No. 60/280,290 filed Mar. 30, 2001.

BACKGROUND OF THE INVENTION

1. Field of the Invention

The present invention relates generally to the control of a defrost heater for a refrigerator and specifically to an adaptive control method and apparatus therefor.

2. Related Art

It is known to provide a defrost heater to a refrigeration unit such as in a domestic refrigerator or freezer appliance. In conventional arrangements, the heater is cycled on the basis of electromechanical timers which accumulate time on the basis of compressor operating time, "run time," or "on time." When the timer accumulates a predetermined amount of compressor operating time, the defrost heater initiates a defrost cycle, regardless of the current state of various refrigeration components and environment. This can lead to an inefficient use of energy.

SUMMARY OF THE INVENTION

According to one aspect of the present invention, a method for controlling a defrosting apparatus in a refrigerator having a compressor is provided. The method comprises the steps of receiving a demand for defrosting, detecting that the compressor is presently operating, and initiating a defrost cycle after the steps of receiving and detecting.

According to another aspect of the present invention, a method of defrosting a refrigerator or freezer having a compressor and a defrost heater is provided. The method comprises the steps of operating the compressor for a duration and energizing the defrost heater based upon completion of the step of operating the compressor.

According to a further aspect of the present invention, a controller for controlling a defrosting apparatus in a refrigerator having a compressor is provided. The controller comprises a defrost determination means for determining when a defrost cycle is needed, a compressor operation detection means for determining whether the compressor is presently operating, a compressor cycle duration determining means for determining the duration of a prior and a present continuous operation cycle, and a defrost initiation means for initiating a defrost cycle based upon the defrost determination means, the compressor operation detection means and the compressor cycle duration determining means.

DETAILED DESCRIPTION OF THE INVENTION

The present invention involves a control method and apparatus for controlling a compressor and a defrost heater for a refrigerator appliance having at least one refrigeration compartment, such as a freezer, with a door. In the present invention, a defrost cycle is initiated at the end of a compressor operation, such that the compressor is operating or has recently stopped operating.

Thus, the defrost heater is turned on only when the freezer has just been cooled. In this way, the deviations of the temperature within the freezer, and of packages therein, are reduced. If the compressor is in the middle of an off cycle, the defrost cycle will not initiate until the next compressor operation.

Figure 1:
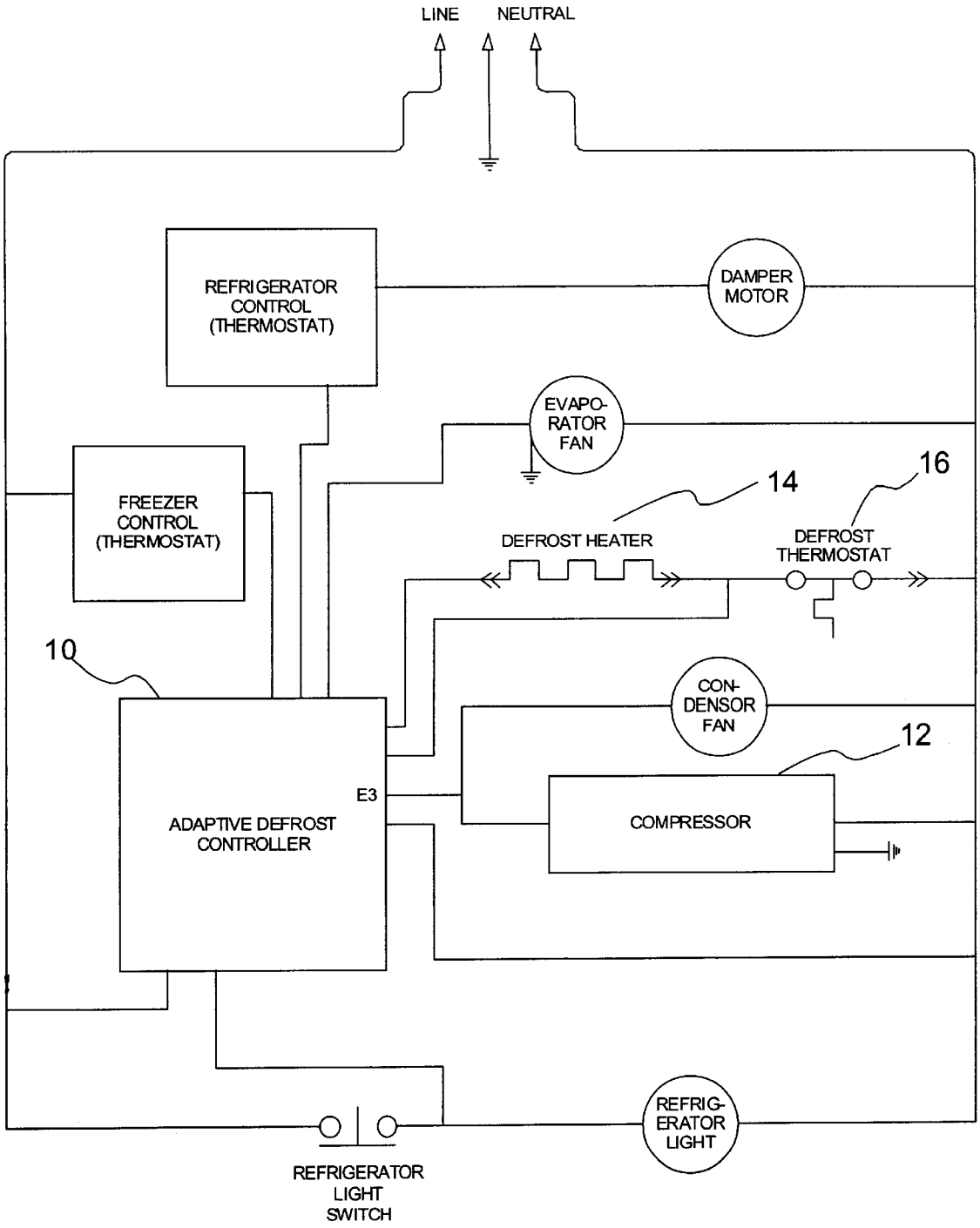
FIG. 1 is a schematic diagram showing the connection of components in a refrigerator adapted to perform the defrost control method according to the present invention.

FIG. 1 shows a wiring schematic for a refrigerator and freezer appliance having an defrost controller 10, a compressor 12, and a defrost heater 14 for carrying out one embodiment of the invention. The controller 10 is programmed to control the defrost heater to carry out the present invention, as described below, as well as acting as a timer means. Thus, one function of the controller 10 is to do the job of the electromechanical timer in the prior art, accumulating compressor operating time until it has accumulated an amount of time equal to a set defrost interval, X. However, it should be appreciated that the timing means of the present invention may be replaced by the traditional electromechanical timer as an alternative to the controller 10.

Figure 2:
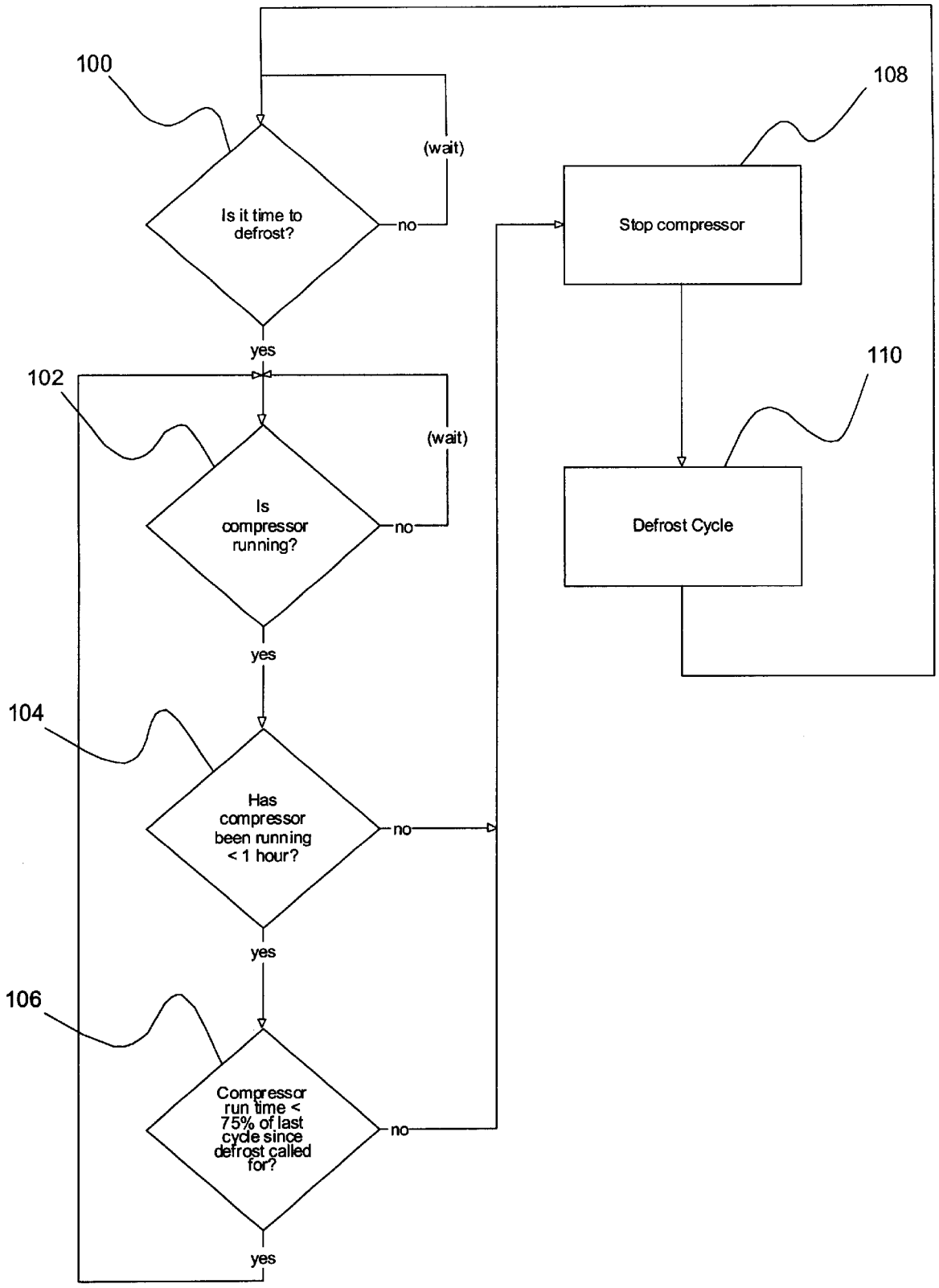
FIG. 2 is a flow diagram showing an embodiment of the defrost control method according to the present invention.

FIG. 2 is a flowchart of the operation an algorithm embodying the compressor operation dependent defrost control described above. The algorithm is designed to initiate the defrost cycle at the end of the compressor operation, by means of a calculated prediction. In step 100 the controller 10 waits for the timer means to indicate that it is time to begin a defrost cycle, at which time control is passed to step 102. In step 102, the operating condition of the compressor 12 is determined by the condition of input E3. If it is determined that the compressor 12 is currently in a operation, control passes to step 104. If the compressor 12 is not currently operating, the controller 10 waits at step 102.

In step 104, if the controller 10 determines that the compressor 12 has been operating for at least one hour, control passes immediately to step 108. If the compressor 12 has been operating for less than one hour, control passes to step 106. In step 106, if the compressor 12 has been operating for at least 75% of the last continuous compressor on time since a defrost was called for, control passes to step 108. Otherwise, the controller 10 repeats steps 102, 104 and 106 until the compressor 12 has been operating for either at least one hour or 75% of the last operating time, whichever is determined to occur first.

Once it is determined that the compressor 12 has been operating for a sufficient time and the controller 100 has proceeded to step 108, the compressor is temporarily stopped. Then, at step 110, a defrost cycle is initiated, including energizing the defrost heater 14 for a period of time, being determined in the present embodiment by a defrost termination thermostat 16. Following the completion of the defrost cycle, the algorithm is restarted at step 100.

FIGS. 3*a*, 3*b*, 3*c* and 3*d* show examples of the operation of the present invention as timing diagrams.

Figure 3A:
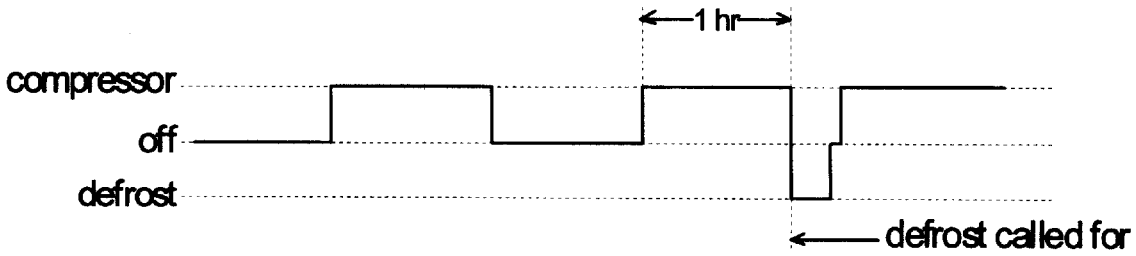
FIGS. 3*a*, 3*b*, 3*c* and 3*d* are timing diagrams illustrating operation of a compressor and defrost cycle according to the present invention.

In FIG. 3*a*, the defrost cycle will not initiate unless the compressor has been operating for a predetermined minimum compressor operating time, such as one hour. This will help ensure that the compartments and any packages contained therein are sufficiently cooled before any heating begins.

Figure 3B:
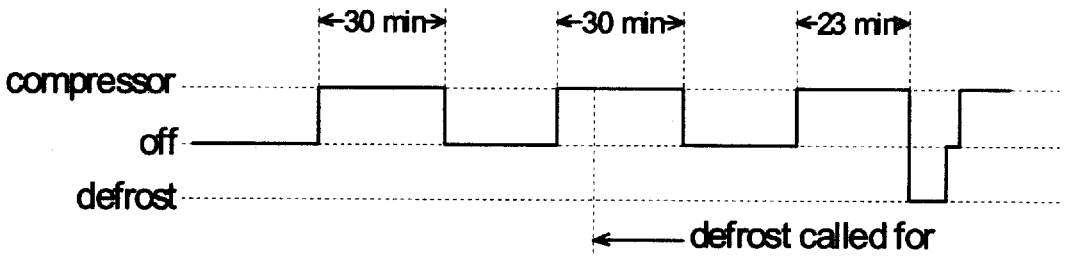
Figure 3C:
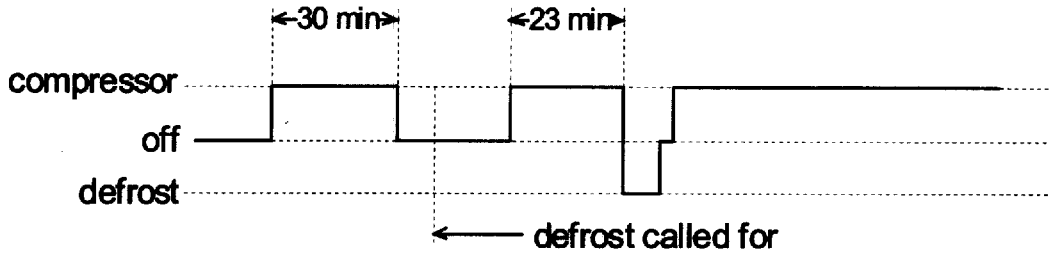
Figure 3D:
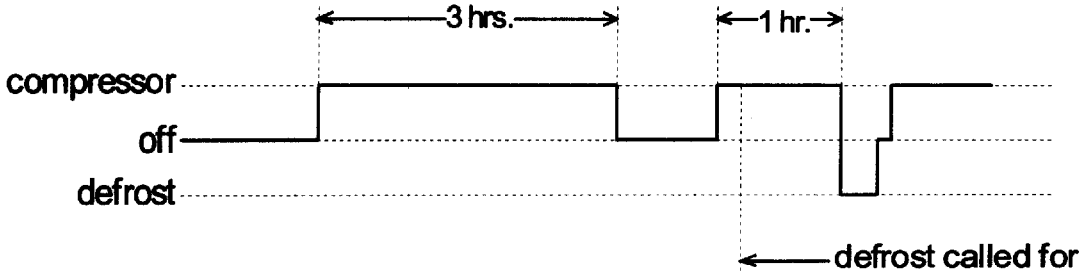

With the above parameters, in the case of a compressor operation that is repeatedly less than one hour, no defrost cycle would ever initiate. As best shown in FIGS. 3*b*, 3*c* and 3*d*, in order to account for this situation, the defrost cycle is alternatively initiated if the compressor has been operating for a minimum percentage of the previous compressor operation, such as 75%.

If a defrost cycle is called for and the compressor operation ends before 1 hour has passed, the defrost cycle is initiated as soon the compressor has been operating for 75% of the duration of that previous cycle. The measurement of the current operation for determining the 75% point begins when the defrost cycle is called for and the compressor is operating.

Thus, in the example of FIG. 3*b*, since the defrost cycle was called for after the compressor operation had already began, and the remaining time in the compressor operation was less than 75% of the previous operation, the defrost cycle did not begin until the next compressor operation.

In the example of FIG. 3*c*, the compressor was not operating when a defrost was called for. As soon as the next compressor operation reached 75% of the previous compressor operation, the defrost cycle was initiated.

In the example of FIG. 3*d*, a defrost cycle was called for during a compressor operation and the defrost cycle was initiated before the compressor operating time had reached 75% of the previous compressor operation. This occurred because the compressor operating time has reached one hour, as set forth above. Thus, the predetermined minimum operating time also acts as a maximum compressor operating time when a defrost cycle is pending.

In the above examples, the defrost cycle will not be initiated if the compressor has stopped operating before a defrost has been called for. However, it is within the scope of the present invention that the defrost heater 14 could be controlled so that a defrost cycle could be initiated during a compressor off cycle, if the compressor 12 has stopped operating within a reasonable time before a defrost cycle is called for. For example, engaging a defrost cycle after a lapse of five minutes from the end of the compressor operation would still reduce freezer temperature deviation. Another example would be to allow the defrost cycle to initiate within a predetermined percentage of a previous compressor operating time, such as 20 percent.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A method for controlling a defrosting apparatus in a refrigerator having a compressor, the method comprising the steps of:

receiving a demand for defrosting;

detecting that the compressor is presently operating; and initiating a defrost cycle only after the steps of receiving and detecting.

2. A method for controlling a defrosting apparatus according to claim 1, further comprising a step of determining a compressor cycle duration measured prior to the present time during which the compressor has been continuously operating, and wherein the defrost cycle is not initiated unless the compressor cycle duration meets or exceeds a defined minimum compressor operation duration.

3. A method for controlling a defrosting apparatus in a refrigerator having a compressor, comprising steps of:

receiving a demand for defrosting;

detecting that the compressor is presently operating;

determining a compressor operating time measured from the reception of the demand to the present time during which the compressor has been continuously operating; and determining a prior compressor cycle duration;

initiating a defrost cycle after the steps of receiving and detecting only if the compressor operating time meets or exceeds a defined minimum percentage of the prior compressor cycle duration.

4. A method for controlling a defrosting apparatus in a refrigerator having a compressor, comprising steps of:

receiving a demand for defrosting;

detecting that the compressor is presently operating;

determining a compressor cycle duration measured prior to the present time during which the compressor has been continuously operating;

determining a compressor operating time measured from the reception of the demand to the present time during which the compressor has been continuously operating; and determining a prior compressor cycle duration;

initiating a defrost cycle after the steps of receiving and detecting only if either the compressor cycle duration meets or exceeds a defined minimum compressor operating duration, or the compressor operating time meets or exceeds a defined minimum percentage of the prior compressor cycle duration.

5. Method for defrosting a refrigerator or freezer having a compressor and a defrost heater comprising the steps of:

operating the compressor for a duration; and energizing the defrost heater based upon completion of the step of operating the compressor;

wherein the duration is a specified minimum duration based upon a preset percentage of the total duration of a previous compressor operation.

6. Method for defrosting according to claim 5 wherein the preset percentage is 75 percent.

7. Method for defrosting a refrigerator or freezer having a compressor and a defrost heater comprising the steps of:

operating the compressor for a duration; and energizing the defrost heater based upon completion of the step of operating the compressor;

wherein the duration is a specified minimum duration based on the lesser of a preset value and a preset percentage of the total duration of a previous compressor operation.

8. Method for defrosting according to claim 7, wherein the preset percentage is 75 percent.

9. Method for defrosting a refrigerator or freezer having a compressor and a defrost heater comprising the steps of:

operating the compressor for a duration; and energizing the defrost heater based upon completion of the step of operating the compressor;

wherein the step of energizing the defrost period is started within a specified period from the completion of the step of operating the compressor, the specified period being based on a specified percentage of the total duration of a previous compressor operation.

10. A controller for controlling a defrosting apparatus in a refrigerator having a compressor, the controller comprising:

a defrost determination means for determining when a defrost cycle is needed;

a compressor operation detection means for determining whether the compressor is presently operating;

a compressor cycle duration determining means for determining the duration of a prior and a present continuous operation cycle; and a defrost initiation means for initiating a defrost cycle based upon the defrost determination means, the compressor operation detection means and the compressor cycle duration determining means.

* * * * *

UNITED STATES PATENT AND TRADEMARK OFFICE

CERTIFICATE OF CORRECTION

PATENT NO. : 6,497,108 B2
DATED : December 24, 2002
INVENTOR(S) : Martin Collins and Harold Mawby It is certified that error appears in the above-identified patent and that said Letters Patent is hereby corrected as shown below:

Title page,
Item [56], References Cited, U.S. PATENT DOCUMENTS, please insert the following references:

| | | | |
|---|---|---|---|
| -- | 5,515,689 | 5/1996 | Atterbury |
| | 5,493,867 | 2/1996 | Szynal et al. |
| | 5,469,715 | 11/1995 | Janke et al. |
| | 5,440,893 | 8/1995 | Davis et al. |
| | 5,363,669 | 11/1994 | Janke et al. |
| | 5,231,844 | 8/1993 | Park |
| | 4,938,027 | 7/1990 | Midlang |
| | 4,884,414 | 12/1989 | Bos |
| | 4,850,204 | 7/1989 | Bos et al. |
| | 4,750,332 | 6/1988 | Jenski et al. |
| | 4,694,657 | 9/1987 | Vaughn |
| | 4,689,965 | 9/1987 | Janke et al. |
| | 4,680,940 | 7/1987 | Vaughn |
| | 4,573,326 | 3/1986 | Sulfstede et al. |
| | 4,573,326 | 3/1986 | Sulfstede et al. |
| | 4,528,821 | 7/1985 | Tershak et al. |
| | 4,481,785 | 11/1984 | Tershak et al. |
| | 4,373,349 | 2/1983 | Mueller |
| | 4,327,557 | 5/1982 | Clarke et al. |
| | 4,299,095 | 11/1981 | Cassarino |
| | 4,251,988 | 2/1981 | Allard et al. |
| | 4,156,350 | 5/1979 | Elliot et al. -- |

Signed and Sealed this

Twentieth Day of May, 2003

JAMES E. ROGAN
*Director of the United States Patent and Trademark Office*